US009163513B2

(12) United States Patent
Bestwick

(10) Patent No.: US 9,163,513 B2
(45) Date of Patent: Oct. 20, 2015

(54) BALANCED ROTOR FOR A TURBINE ENGINE

(75) Inventor: Michael Bestwick, Ripley (GB)

(73) Assignee: ROLLS-ROYCE plc, London (GB)

( * ) Notice: Subject to any disclaimer, the term of this patent is extended or adjusted under 35 U.S.C. 154(b) by 976 days.

(21) Appl. No.: 12/776,785

(22) Filed: May 10, 2010

(65) Prior Publication Data

US 2010/0296937 A1 Nov. 25, 2010

(30) Foreign Application Priority Data

May 19, 2009 (GB) ..... 0908502.8

(51) Int. Cl.
*F01D 5/30* (2006.01)
*F01D 5/02* (2006.01)

(52) U.S. Cl.
CPC ..... *F01D 5/027* (2013.01); *F01D 5/3038* (2013.01); *F05D 2260/96* (2013.01); *Y10T 29/49332* (2015.01)

(58) Field of Classification Search
CPC ..... F01D 5/027; F01D 5/10; F01D 25/04; F01D 5/3038; F05D 2230/60; F05D 2260/15; F05D 2260/80; F05D 2260/96
USPC ..... 416/144, 145, 219 R, 220 R, 500, 215, 416/216, 218; 415/119
See application file for complete search history.

(56) References Cited

U.S. PATENT DOCUMENTS

| | | | | |
|---|---|---|---|---|
| 3,088,708 | A * | 5/1963 | Feinberg | 416/215 |
| 3,216,700 | A * | 11/1965 | Bostock, Jr. | 416/216 |
| 3,383,094 | A * | 5/1968 | Diggs | 416/221 |
| 4,280,795 | A * | 7/1981 | Trousdell | 416/218 |
| 4,743,166 | A * | 5/1988 | Elston et al. | 416/215 |
| 4,818,182 | A * | 4/1989 | Bouru | 416/215 |
| 4,879,792 | A * | 11/1989 | O'Connor | 29/889 |
| 5,018,943 | A * | 5/1991 | Corsmeier et al. | 416/144 |
| 5,160,243 | A * | 11/1992 | Herzner et al. | 416/220 R |
| 6,279,420 | B1 * | 8/2001 | Knorowski et al. | 464/180 |
| 6,332,617 | B1 * | 12/2001 | Leveaux et al. | 277/433 |
| 6,464,463 | B2 * | 10/2002 | Yvon Goga et al. | 416/215 |
| 6,752,598 | B2 * | 6/2004 | Antunes et al. | 416/215 |
| 6,981,847 | B2 * | 1/2006 | Arinci et al. | 416/193 A |
| 7,198,463 | B2 * | 4/2007 | Kanebako et al. | 415/175 |
| 2003/0123986 | A1 * | 7/2003 | Antunes et al. | 416/220 R |
| 2009/0053056 | A1 * | 2/2009 | Finneran et al. | 415/209.3 |

OTHER PUBLICATIONS

Aug. 26, 2009 Search Report issued in British Patent Application No. 0908502.8.

* cited by examiner

*Primary Examiner* — Sean J Younger
(74) *Attorney, Agent, or Firm* — Oliff PLC

(57) ABSTRACT

A balanced rotor of a turbine engine, having a rotor disc with a circumferential slot and a row of rotor blades mounted in the slot and a balance weight having a land which extends beneath the root of a blade and having a mass-adjustment protrusion extending from the land in a radial direction relative to the axis of the rotor component and which lies wholly between the blade root and an adjacent blade root.

15 Claims, 4 Drawing Sheets

BALANCED ROTOR FOR A TURBINE ENGINE

The present invention relates to the balancing of rotors in and for a turbine engine and particularly the balancing of compressor or turbine discs, drums or rings having circumferential slots within which the roots of rotor blades are located.

Referring to FIG. 1, a turbofan gas turbine engine 10 comprises in flow series an inlet 32, a fan 2 and a core engine 4 comprising an intermediate pressure compressor 12, a high pressure compressor 14, a combustor 16, a high pressure turbine 18, an intermediate pressure turbine 20, a low pressure turbine 22 and an exhaust 24. The fan 2, compressors 12, 14, and turbines 18, 20, 22 are all arranged to rotate about a central common engine axis 1. Air is drawn into the engine 10, as shown by arrow B, through the annular inlet 32 and into the fan 2. The fan 2 compresses the air and a portion flows, in a downstream direction, into the core engine 4 where it is further compressed, mixed with fuel and burnt in the combustor 16 before being expanded in the turbine and expelled through the core exhaust 24 as shown by arrow D.

Throughout this specification the terms 'downstream' and 'upstream' are used with respect to the general direction of gas flow through the engine 10.

The compressor consists of one or more rotor assemblies that carry rotor blades of aerofoil cross-section. The rotor is located by bearings which are supported by the casing structure. The casing incorporates stator vanes also of aerofoil cross-section, which are axially aligned behind the rotor blades. Each rotor and downstream stator form a stage.

Blades are normally mounted onto a compressor disc using a mechanical fixture known as a root fixing. There are two principal fixing methods in use: Axial fixing and circumferential fixing. In axial fixing a circumferential series of axially extending slots are machined out of the disc in a complimentary shape to accept the dovetail or fir-tree shaped rotor blade fixing which are slid into the slot—one blade fixing per slot—and secured with a securing element such as a lockstrap. For a circumferential fixing a circumferential groove is machined out of the disc in a complimentary shape to accept the dovetail or fir-tree shaped rotor blade fixings which are slid into the slot. Multiple blades are loaded into the slot via a loading slot which is then closed with a locking device. It is easier to manufacture a single circumferential slot than multiple axial slots and accordingly the circumferential fixing is a simpler and cheaper option and is used for most stages of a typical compressor. Axial fixings, however, are generally more robust for handling foreign object damage and better facilitate the use of variable vanes. For these reasons, the front stages of a compressor tend to use axial fixings.

The rotating assemblies must be balanced to high tolerance since any unbalance is capable of producing vibration and stresses, which increase as the square of the rotational speed. The present invention seeks to provide improved balancing apparatus and an improved method of balancing a rotor.

According to the invention there is provided a balanced rotor of a turbine engine, comprising: a rotor component extending around an axis and having a circumferential slot; a row of rotor blades extending radially outwardly from the circumference of the rotor component, each blade having a blade root inserted within the circumferential slot; a balance weight within the circumferential slot, the weight having a land which extends beneath a blade root and having a mass-adjustment protrusion extending from the land in a radial direction relative to the axis of the rotor component and which lies wholly between the blade root and an adjacent blade root and has a width in the axial direction that is less than the axial width of the slot.

Preferably the land extends beneath the blade root and the adjacent blade root.

Preferably the protrusion has a first stop-face located against the blade root and prohibiting circumferential movement of the weight in a direction towards the blade root. Preferably the protrusion has a second stop-face located against the adjacent blade root and prohibiting circumferential movement of the weight in a direction towards the adjacent blade root.

The land may have edges that extend in a circumferential direction, the edges each having a lip aligned with a respective root chamfer for prohibiting axial movement of the weight relative to the root. Preferably each lip extends from the land in the same direction in which the mass-adjusting protrusion extends.

The rotor component may be a rotor disc, drum or ring for a turbine or compressor According to a second aspect of the invention there is provided a balance weight for balancing a rotor of a turbine engine, comprising: a rotor component extending around an axis and having a circumferential slot; and a row of rotor blades extending radially outwardly from the circumference of the rotor component, each blade having a blade root inserted within the circumferential slot; wherein the balance weight has a circumferentially extending land for extending beneath the roots of adjacent blades and having a mass-adjustment protrusion extending from the land, the mass-adjusting protrusion having a circumferential length less than the distance between the adjacent blade roots and having one or more stop-faces for locating against the blade root and prohibiting circumferential movement of the weight in use.

The land may be rectangular and have two longer edges for extending circumferentially within the slot and two shorter edges, the two longer edges each having a lip that extends from the land in the same direction in which the mass-adjusting protrusion extends for aligning with a respective root chamfer for prohibiting axial movement of the weight relative to the root.

The invention will now be described by way of example only with reference to the accompanying figures, in which.

Figure 1:
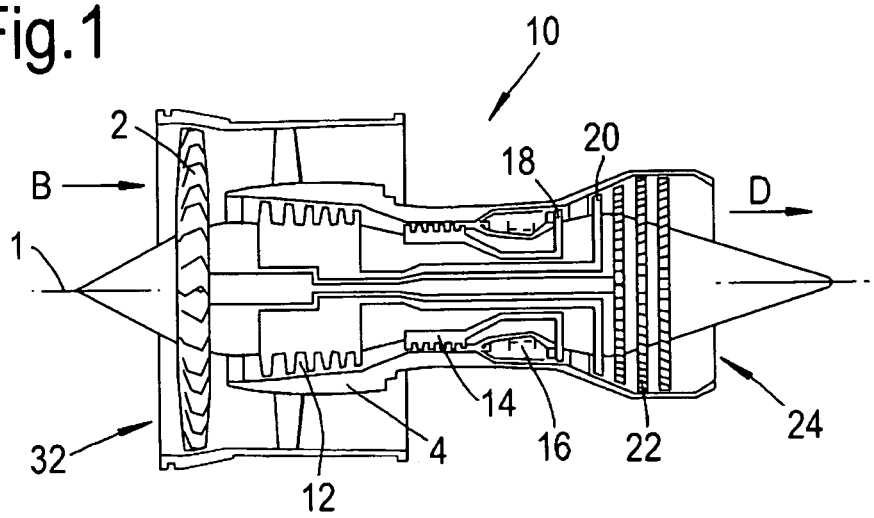
FIG. 1 depicts a schematic of a cross-section of a turbofan gas turbine engine.
Figure 2:
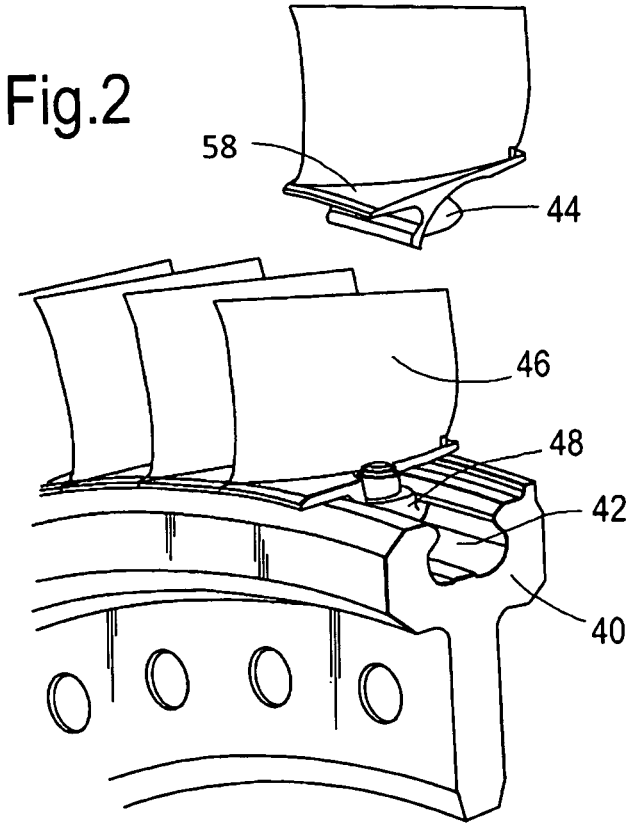
FIG. 2 depicts an array of blades mounted on a compressor disc.

FIG. 2 is a perspective view of a blade disc 40 having a circumferential slot 42 within which a blade 46 is held by its root 44 located within the circumferential slot. The circumferential slots are conventional and may be in dovetail, firtree or other known arrangement in which the slot has a neck that opens to an appropriately cross-sectioned securing cavern. Each blade has a platform which is sized to abut against a platform of an adjacent blade to provide a continuous radially inner surface for the blade passages. At least one of the platforms has a cut out through which a jacking screw is inserted to engage a locknut 48. Turning of the jacking screw causes the locknut to held against the overhangs either side of the dovetail neck. Because the locknut is secured circumferential movement of the blades within the slot is prevented.

Figure 3:
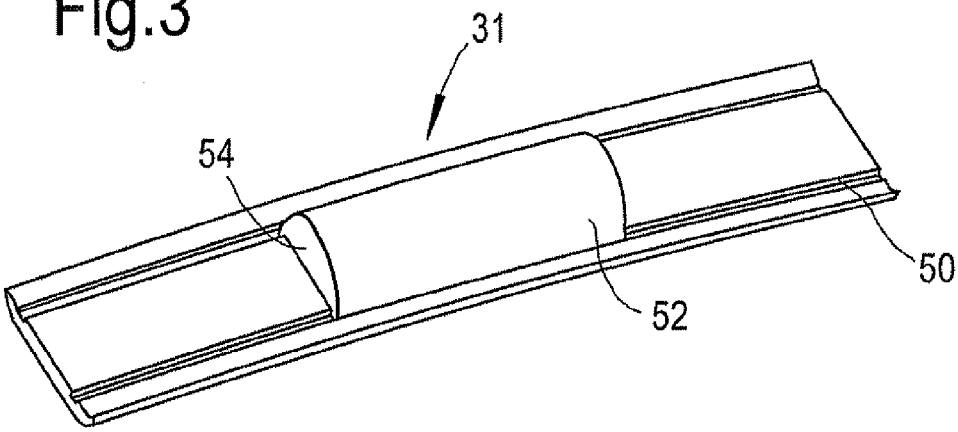
FIGS. 3 and 4 show exemplary balance weights in accordance with the invention.
Figure 4:
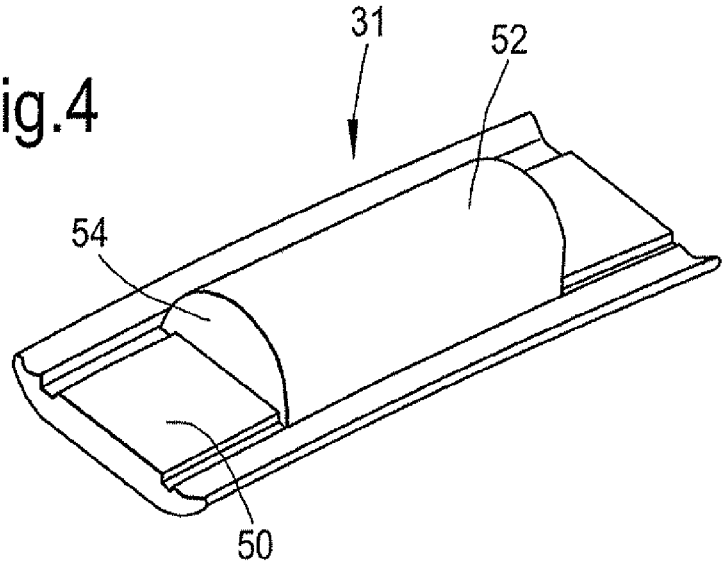
Figure 5:
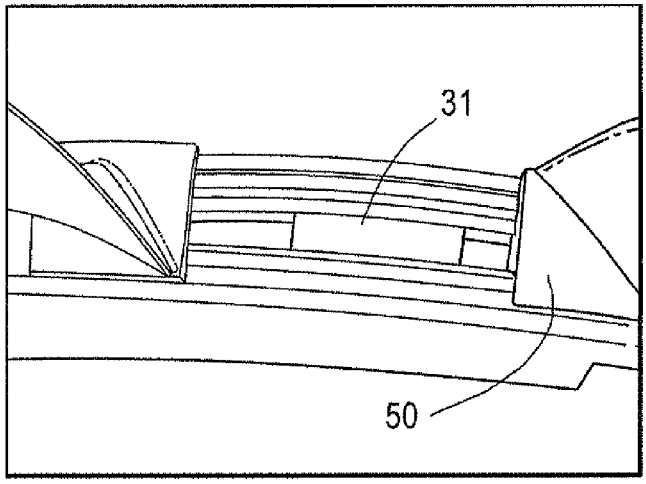
FIGS. 5 to 8 depict steps for loading a balance weight into a circumferential rotor slot.

One or more balance weights are provided within the circumferential slot 42 to balance the disc. The weight 31 has the form generally described with reference to FIGS. 3 and 4. Each weight has a first portion or lands 50 intended for fitting under the root of a blade and providing radial location for the balance weight under the blade root and a second portion 52 which provides an area for mass adjustment and trim dressing if required.

The whole weight 31 has dimensions that permit its loading into the circumferential slot in which it is intended to be located in use. The dimensions therefore vary depending on the type of engine and stage of the compressor or turbine in which the blade is used.

The lands 50 are generally planar and of a height that permits it to fit beneath the root of a blade. Along the circumferentially extending edges of the lands the edges are curved or angled to provide axial location features which abut corresponding features on the root of the blade in use and prohibit axial movement of the weight within the slot.

The second portion 52 is projects from the first portion and has faces 54 which in use abut the side face of the blade root and prohibits the weight from sliding under the blades and therefore provides circumferential location. It is preferable that the length of the second portion is equal to the distance between the side faces of adjacent roots though a length of second portion less that the distance between the side faces of adjacent roots may also be used. In either case it is important that return of the blades and platform to their normal in-use spacing is not prevented.

The width of the second portion in the axial direction is less than the neck width which allows the balance weight to be located at any desired circumferential location.

Although the second portion 52 has been shown to be a single block it is possible to machine out sections from the portion 52 either by drilling, cutting or any other appropriate chemical or mechanical means to trim the mass of the portion. Other cross-sectional shapes may also be used that the semi-circular or the faceted semi-decagonal shapes depicted.

Fitting of the weight will now be described with reference to FIGS. 5 to 8 for a compressor rotor assembly having dovetail slots, the blades of which having been mounted in a conventional manner through a loading slot and then secured through a circumferential locking nut.

The circumferential position to which the balance weights are to be located is determined by any conventional means following which the circumferential locking nuts are removed and several blades released from the circumferential slot through the loading slot. This creates space in the slot that allows blades to be slid circumferentially permitting gaps greater than the length of the weight to be opened between the blades.

Figure 6:
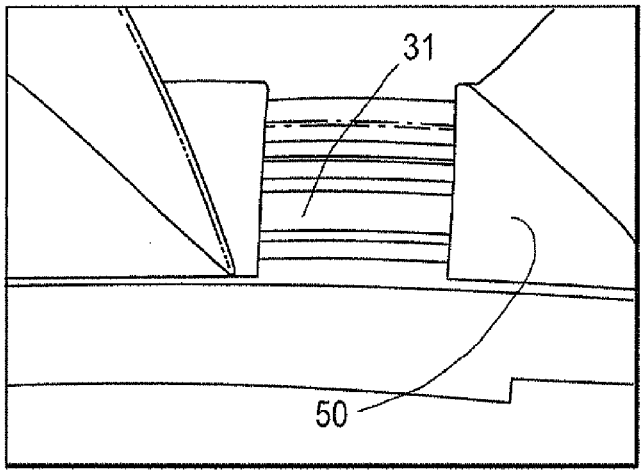
Figure 7:
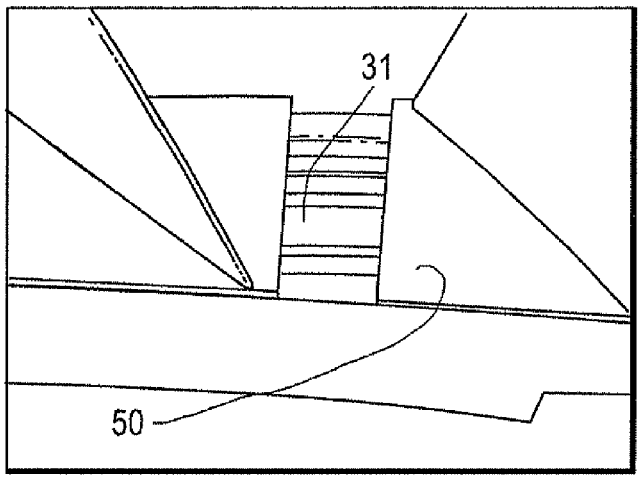
Figure 8:
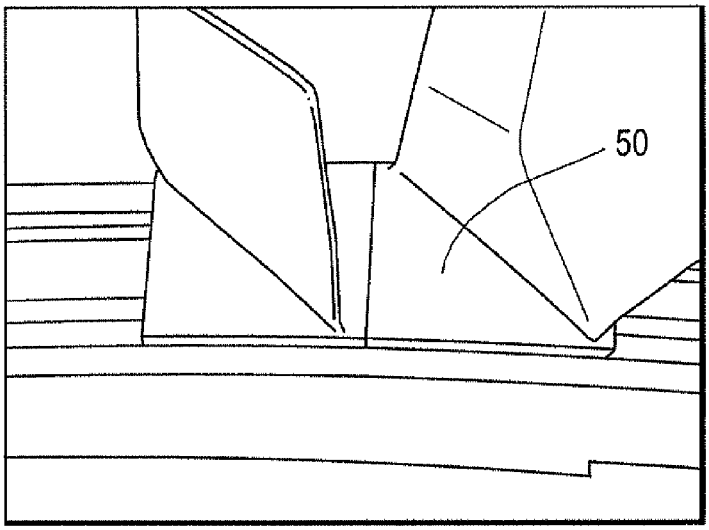

The weight is placed into the slot (FIG. 5) between the blades and slid circumferentially so that one of the lands slides under one of the blade roots and the face 54 of the raised second portion abuts the side of the root as shown in FIG. 6. The gap between the blades is then closed up again (FIGS. 7 and 8) till the platforms 58 of the adjacent blades abut each other. Beneficially, in this arrangement the two blades can be moved circumferentially as a unit to their operating position and the weight will move with them to its operating location. It will be appreciated that the lands need not extend under the whole circumferential length of the blade root.

Once all weights have been located to their operating position between blades it is possible for the slot to have the removed blades refitted and the locknuts secured to hold all the blades in their circumferential place.

It will be appreciated that this is an elegant way of balancing the disc having blades mounted in a circumferential slot without having to remove a significant number of blades. Beneficially the balance weight or weights can be fitted following a tip grind, which is where the assembly is spun and the tips of longer blades machined by grinding to provide a uniform tip gap.

Figure 9:
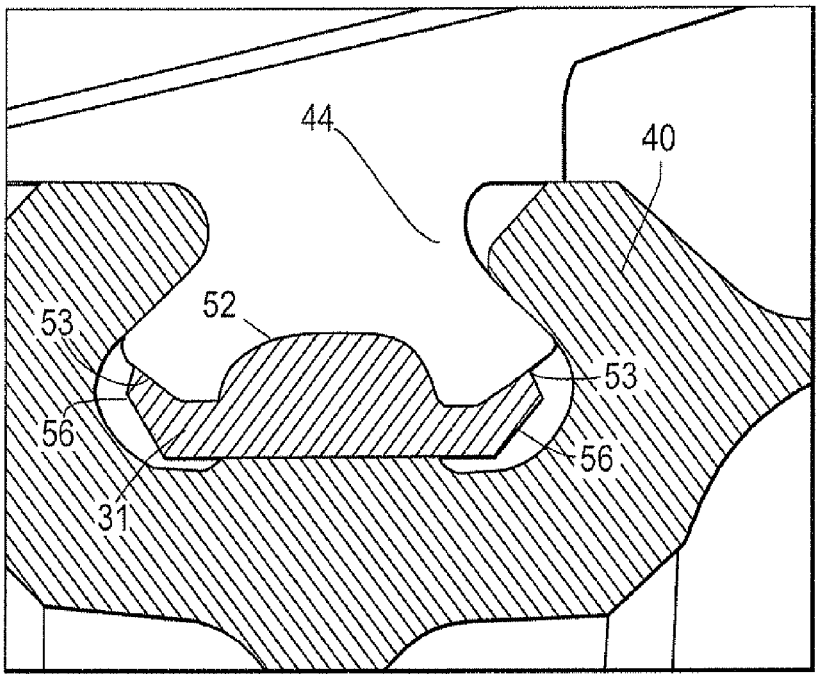
FIG. 9 depicts s a balance weight located in position in a rotor slot.

A balance weight in location is shown in FIG. 9. The weight 31 is shown with the lands located under the root 44 of the blade. The root is provided with chamfers 53 at its axial upstream and axially downstream edges. The upturned edges 56 of the weight, which need not extend along the whole length of the balance weight, align with the chamfers and inhibit axial movement of the weight relative to the root and similarly inhibits axial movement of the weight relative to the slot. The central portion of the weight 52 is depicted by the dashed line shows that its height is too great to fit under the root and is therefore prevented from moving past the root by face 54 (FIG. 3 and FIG. 4) which serves to provide a circumferential stop for the balance weight.

The radial load of the balance weight is carried through the blade root with is either a dovetail, firtree or other appropriate shape. The balance weight may be fitted at any circumferential position but difficulty may be found adjacent to the loading slot. If balancing is required at this location then weights with smaller mass may be provided in the slot at locations on either side of the loading slot, their mass being determined using vector summation.

Where there is a relatively large gap between the blade root and the radially inner surface of the circumferential slot it is possible to put discrete pips or projections on the reverse surface of the land to that of the mass-adjusting portion. The pips space the land from the inner surface of the slot to ensure the land and the lips on the land contact the blade root.

A variety of different materials may be used for the weight to give the necessary balance correction. Alternatively, the weights could have different heights or lengths to provide the desired mass provided they still fit within the slot and the lands can locate under the roots. The colour of the weights may be modified by heat treatment or painting to allow particular ranges to be easily identified or to identify weights for different applications or product type use.

The invention claimed is:

1. A balanced rotor for a turbine engine, comprising:

a rotor component extending around an axis and having a circumferential slot;

a row of rotor blades extending radially outwardly from the circumference of the rotor component, each blade having a blade root inserted within the circumferential slot; and a balance weight within the circumferential slot, the weight having a land which extends beneath a blade root and having a mass-adjustment protrusion extending from the land in a radial direction relative to the axis of the rotor component and which lies wholly between the blade root and an adjacent blade root and has a width in the axial direction that is less than the axial width of the slot, wherein the slot has a radially outer neck opening to a radially inner securing cavern, and the width of the mass adjustment protrusion is less than the width of the slot neck;

wherein the land has edges that extend in a circumferential direction, the edges each having a lip aligned with a respective root chamfer for prohibiting axial movement of the weight relative to the root; and wherein each lip extends from the land in the same direction in which the mass-adjusting protrusion extends.

2. A balanced rotor according to claim 1, wherein
the land extends beneath the blade root and the adjacent blade root.

3. A balanced rotor according to claim 1, wherein
the protrusion has a first stop-face located against the blade root and prohibiting circumferential movement of the weight in a direction towards the blade root.

4. A balanced rotor according to claim 3, wherein
the protrusion has a second stop-face located against the adjacent blade root and prohibiting circumferential movement of the weight in a direction towards the adjacent blade root.

5. A balanced rotor according to claim 1, wherein
the balance weight is a single piece component.

6. A balanced rotor according to claim 1, comprising a plurality of balance weights.

7. A balanced rotor according to claim 6, wherein
at least two of the balance weights are selected to have mass adjustment protrusions of different mass.

8. A method of balancing a rotor, the rotor comprising:
a rotor component extending around an axis and having a circumferential slot and a row of rotor blades extending radially outwardly from the circumference of the rotor component, each blade having a blade root inserted within the circumferential slot;
the method comprising the steps of determining the circumferential location for placement of a balance weight;
moving apart two of the rotor blades in the row;
inserting a balance weight within the circumferential slot between the two rotor blades, the weight having a land which extends beneath a blade root of one of the two rotor blades and having a mass-adjustment protrusion extending from the land in a radial direction relative to the axis of the rotor component and which lies wholly between the blade root and the blade root of the other of the two rotor blades, wherein
the slot has a radially outer neck opening to a radially inner securing cavern, and the width of the mass adjustment protrusion is less than the width of the slot neck, and
the land has edges that extend in a circumferential direction, the edges each having a lip aligned with a respective root chamfer for prohibiting, axial movement of the weight relative to the root; and
moving the two rotor blades together.

9. A method according to claim 8, wherein
the width of the mass-adjustment protrusion in the axial direction is less than the axial width of the slot.

10. A method according to claim 8, wherein
the method further comprises the step of rotating the rotor and taking measurements to determine the circumferential location for placement of the balance weight.

11. A balanced rotor for a turbine engine, comprising:
a rotor component extending around an axis and having a circumferential slot;
a row of rotor blades extending radially outwardly from the circumference of the rotor component, each blade having a blade root inserted within the circumferential slot; and
a balance weight wholly within the circumferential slot, the weight having aloud which extends beneath a blade root and having a mass-adjustment protrusion extending from the land in a radial direction relative to the axis of the rotor component and which lies wholly between the blade root and an adjacent blade root and has a width in the axial direction that is less than the axial width of the slot, wherein
the land has edges that extend in a circumferential direction, the edges each having a lip aligned with a respective root chamfer for prohibiting axial movement of the weight relative to the root.

12. A balanced rotor according to claim 11, wherein
the blades have platforms that abut to form a gas washed surface, the balance weight located wholly between the platforms and a base of the circumferential slot.

13. A balanced rotor according to claim 12, wherein
the slot has a radially outer neck opening to a radially inner securing cavern, wherein the width of the mass adjustment protrusion is less than the width of the slot neck.

14. A balanced rotor according to claim 1, wherein
the land is substantially planar.

15. A balanced rotor according to claim 14, wherein
the land has a width that is equivalent to a width of the mass-adjustment protrusion.

* * * * *